United States Patent [19]

Rüscher

[11] 3,976,258

[45] Aug. 24, 1976

[54] METHOD OF AND APPPARATUS FOR FORMING A PACKAGE ON A ROTATABLE TAKE-UP DEVICE

[75] Inventor: Markus Rüscher, Schonau, Germany

[73] Assignee: Maschinenfabrik Zeil J. Kruckels KG, Zell, Germany

[22] Filed: Feb. 13, 1975

[21] Appl. No.: 549,687

[30] Foreign Application Priority Data

Feb. 16, 1974 Germany ..... 2407476

[52] U.S. Cl. ..... 242/75.51

[51] Int. Cl.[2] ..... B65H 59/38

[58] Field of Search..... 242/75.51, 75.52, 75.53, 242/75.5

[56] References Cited

UNITED STATES PATENTS

| | | | |
|---|---|---|---|
| 2,975,991 | 3/1961 | Michel | 242/75.51 |
| 2,978,200 | 4/1961 | Larson | 242/75.51 |
| 3,241,785 | 3/1966 | Barrett | 242/75.51 |
| 3,650,490 | 3/1972 | Saunders | 242/75.51 |
| 3,701,493 | 10/1972 | Welsch | 242/75.51 |
| 3,871,598 | 3/1975 | Kataoka | 242/75.51 |

FOREIGN PATENTS OR APPLICATIONS

| | | | |
|---|---|---|---|
| 1,286,367 | 1/1969 | Germany | 242/75.51 |

*Primary Examiner*—Edward J. McCarthy
*Attorney, Agent, or Firm*—Michael J. Striker

[57] ABSTRACT

An elongated flexible workpiece is advanced at a predetermined speed towards a rotatable take-up device, and the workpiece is wound onto the device to form a package thereon. The tension of the workpiece is selected to either be constant, progressive or degressive in accordance with the change in the diameter of the package.

19 Claims, 18 Drawing Figures

19
52
17
13a
IV
16
12
20
13
14
15a
15
St
21
24a
60
24
25a
17
25
S
30a
18
22
31
23
30
26
28
Pf 6
27
32
33
39
IV
29
37
38
36
50
8/9
70
51
40
41
5

VIII 21
20
19
52
71
72
73
M
71a
72a
76
76a
75
75a
77
24
24a
74
30a
25
18
31
22
23
27
28
26
PF 6
30
32
33
VII
8/9

Fig 13
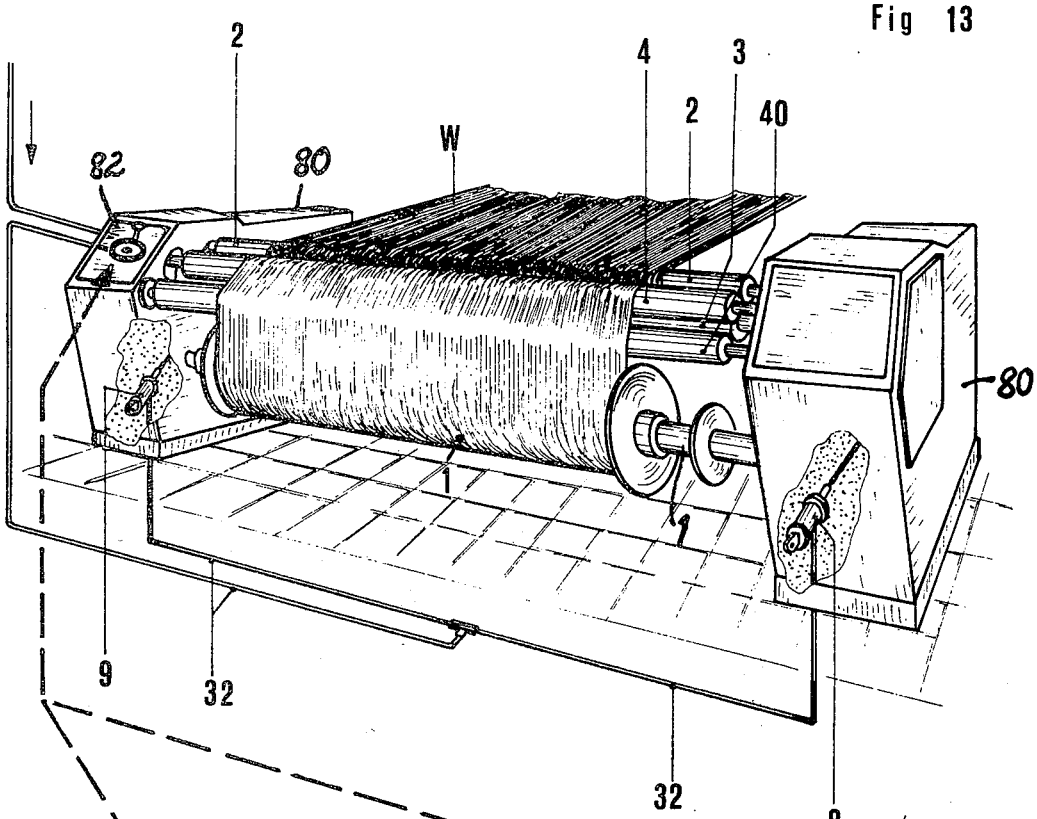
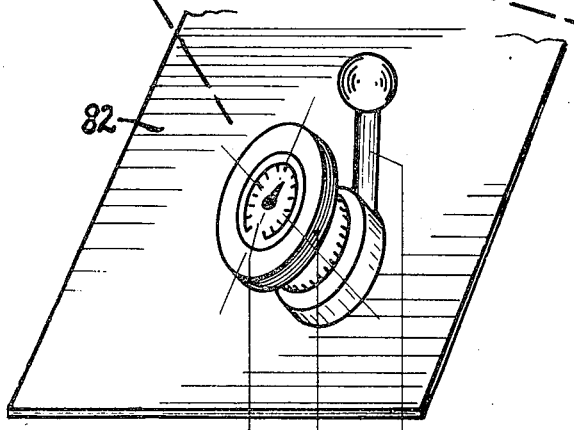
Fig. 14
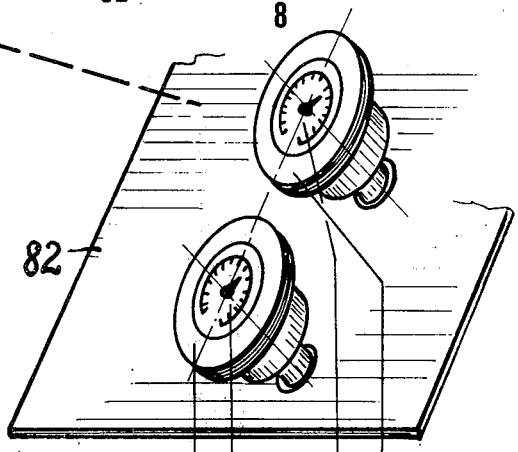
Fig. 15

METHOD OF AND APPPARATUS FOR FORMING A PACKAGE ON A ROTATABLE TAKE-UP DEVICE

BACKGROUND OF THE INVENTION

The present invention relates generally to the formation of a package on a rotatable take-up, and more particularly to a method of forming such a package and to an apparatus for carrying out the method.

It is already known in the art to form packages on rotatable take-ups by winding an elongated flexible workpiece, for example tapes, filaments, strands or the like, onto the take-up. It is also known to wind the material onto the take-up under a constant tension. The prior art experiences difficulty because as the diameter of the package increases, the tension on the workpiece tends to produce a cinching effect upon the package, that is the outer workpiece convolutions exert an inwardly directed constricted action upon the package. This, in turn, has various disadvantages. One of these is the fact that a component of the inwardly directed force tends to act axially, exerting a substantial pressure upon the end flanges of the take-up device. Moreover, and perhaps even more importantly, the inner layers of the material on the package tend to become deformed and convolutions in one layer (e.g., convolutions of a filament) tend to be pushed underneath convolutions of a subjacent layer. When such a package is subsequently unwound, this causes very substantial difficulties and frequently leads to breakage of the filament or other workpiece. Since such packages are used in extremely large numbers on automatic equipment, such as weaving machines or the like, this means downtime for the machine leading to losses in the economy of production, and also to a reduction in the quality of the goods being produced with the filament or the workpiece.

These difficulties are observed with all kinds of filaments, yarns, tapes or the like, including textile webs, and they have been observed to increase in frequency as the diameter of the package being formed increases.

SUMMARY OF THE INVENTION

Accordingly, it is an object of this invention to overcome the disadvantages of the prior art.

More particularly, it is an object of this invention to provide an improved method of forming a package on a rotatable take-up device, which method is not possessed of these disadvantages.

Another object of the invention is to provide an apparatus for carrying out the method.

In keeping with these objects, and with others which will become apparent hereafter, one feature of the invention resides in a method of forming a package on a rotatable take-up device which, briefly stated, comprises the steps of advancing an elongated flexible workpiece at a predetermined speed towards a rotatable take-up device, winding the workpiece onto the take-up device to form a package thereon, and selecting the tension of the workpiece from a constant tension mode, a progressive tension mode and a degressive tension mode.

The present invention assures, for example in the case of a package composed of a plurality of superimposed layers of filament or the like, that the integrity of the layers is retained and that the frequent breakage which is found in the prior art will be avoided.

In the case of all types of workpieces which are to be formed into a package in accordance with the present invention, the invention assures advantageous workpiece tensions in accordance with the particular diameter which the package has at any time during its winding, thus assuring that an increasing package diameter is not accompanied by increasing forces tending to constrict the package and cause the earlier-described difficulties, and also eliminating pressure acting axially of the package and tend to deform the package and also exert forces upon the flanges of the take-up device.

The present invention makes it possible to accommodate the workpiece tension which is to be associated with a particular package diameter, to the requirements for proper winding up and subsequent winding off of the workpiece from the package. Particularly if long workpieces and large package diameters are involved, the tension of the workpiece during winding up can be varied over the entire winding range, that is from the beginning of the package formation to the completion of the package formation, according to a desired characteristic without having to accept the previously-mentioned difficulties. It is possible to select a constant workpiece tension from the beginning of the package formation to the completion of the package formation. The workpiece tension can also be increased as the diameter of the package increases, and in a selected ratio relative thereto. Of course, the workpiece tension can simply be increased as the package diameter increases, without selecting a certain ratio of tension increase relative to package diameter increase, or an arbitrary value can be selected. Similarly, a decrease of the tension of the workpiece can also be selected.

The novel apparatus for carrying out the method comprises a rotatable take-up, first means for feeding an elongated flexible workpiece towards the take-up to be wound onto and form a package on the same, including a swingable tensioning roller adapted to exert tension upon the workpiece. Variable second means is provided for rotating the take-up in dependence upon the diameter of the package thereon. Fluid actuated third means is provided for the swingable roller to press the same against the workpiece. An electric control circuit is provided for the variable second means, including a first adjustable potentiometer. A tension control circuit controls the tension exerted by the swingable roller and includes a second adjustable potentiometer mechanically coupled with the first potentiometer, and a third adjustable potentiometer which is electrically coupled with the second potentiometer. Fourth means includes a cam surface means and/or a follower means whose movements are controlled by the adjustments of the third potentiometer, for preselecting the force exerted by the fluid-actuated third means upon the swingable roller.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIGS. 9*a*, 9*b* and 9*c* are fragmentary views analogous to FIG. 9, but illustrating the lower ends of modified elements;

FIG. 13 is a fragmentary perspective view illustrating the relative location and orientation of various components of the apparatus;

FIG. 14 is a perspective view showing the arrangement of the control arrangement for the machine in FIG. 13; and FIG. 15 is a view similar to FIG. 14, but showing the mounting of a different control arrangement for the machine in FIG. 13.

DESCRIPTION OF THE PREFERRED EMBODIMENTS

Figure 1:
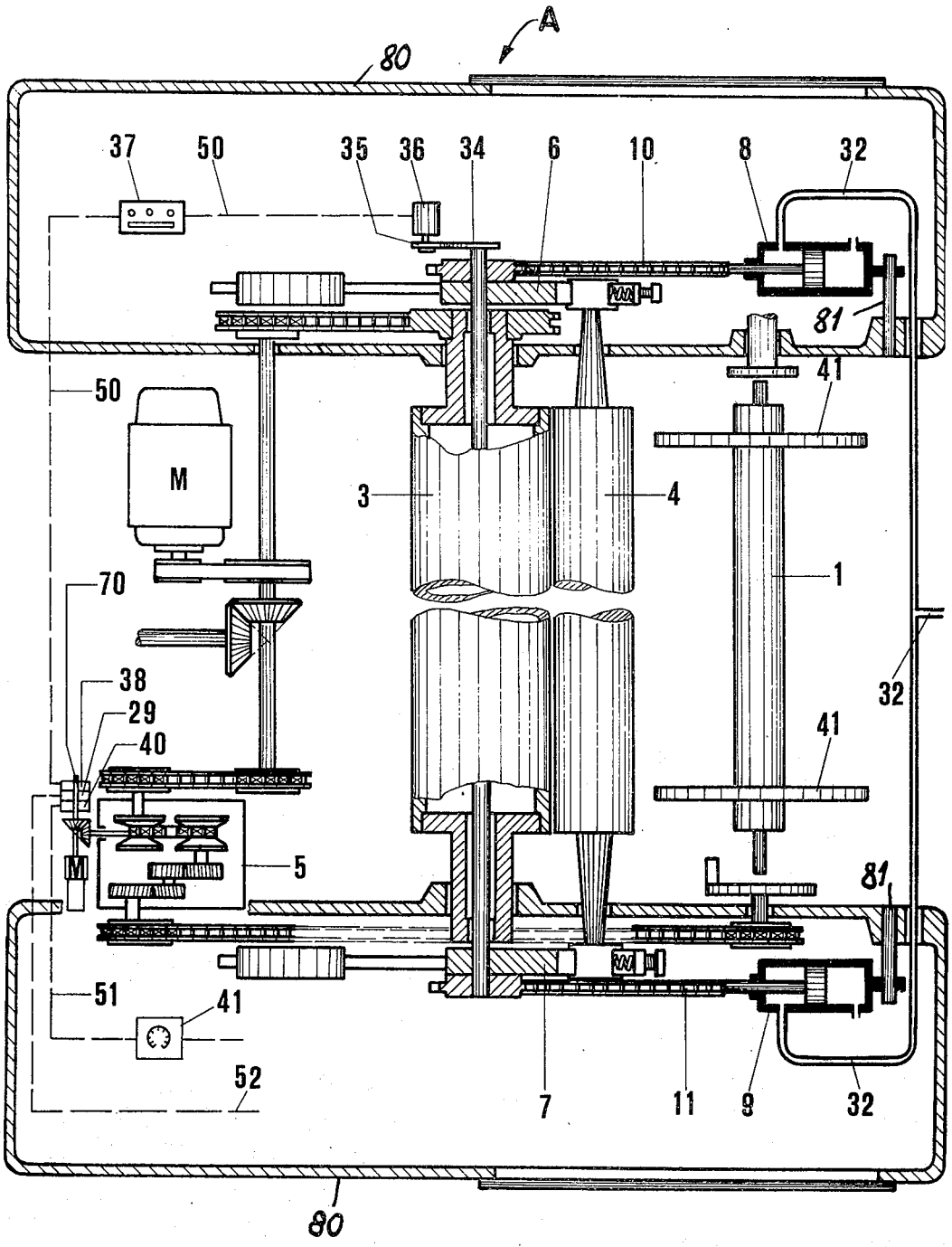
FIG. 1 is a partly sectioned top-plan view of an apparatus according to the present invention.
Figure 2:
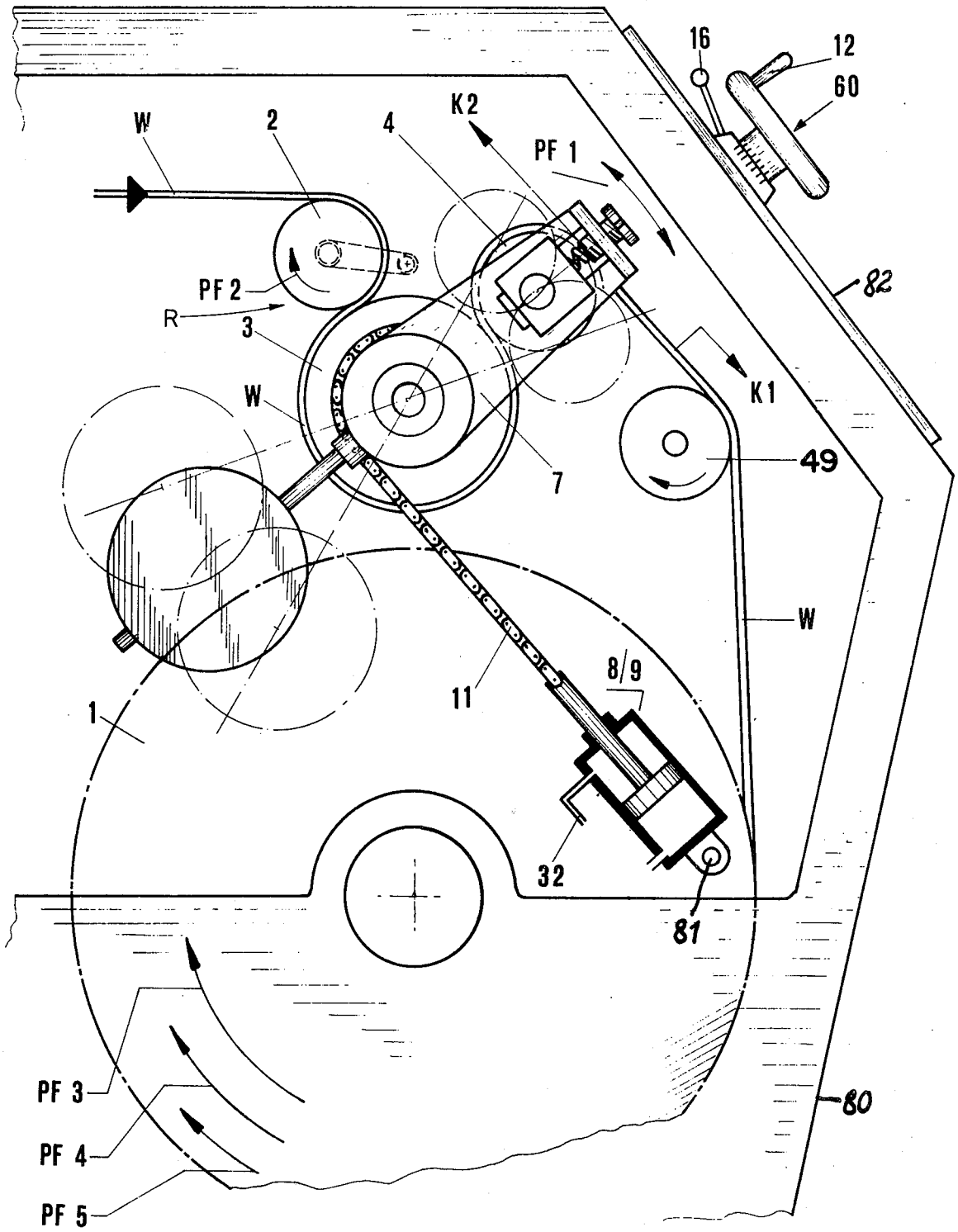
FIG. 2 is a very diagrammatic side view of the embodiment in FIG. 1.

Referring firstly to FIGS. 1 and 2, it will be seen that a take-up A is shown which serves to wind an elongated flexible workpiece onto a spool, bobbin, reel or the like, which is generally identified with reference numeral 1. For the sake of explanation, the workpiece will hereafter be described as a filament, although it has been pointed out above that it could also be of a completely different character.

The workpiece itself is identified with reference character W and is withdrawn by a feeding arrangement R from a source of supply (not illustrated) over a workpiece guide roller 4*a*. The arrangement R is composed of essentially of three rollers 2, 3 and 4, of which the roller 3 is preferably provided with a coating of synthetic or natural rubber or plastic. The roller 4 is mounted so that it can swing and is a tension roller, as indicated by the the double headed arrow PF1 in FIG. 2. In cooperation with a regulating arrangement 5, it controls the tension of the workpiece W intermediate the take-up 1 and the arrangement R. The latter is driven directly by a motor M, essentially at constant speed as indicated by the arrows PF2 and also shown in FIGS. 1 and 2. This constant speed of the arrangement R can be selected differently in dependence upon the different type of workpiece W, but for purposes of the following explanation and for reasons of simplicity it will be assumed that the speed at which the workpiece W is fed towards the take-up 1 is constant.

That being the case, the rotations of the take-up 1 must be varied as the diameter of the package being formed with the take-up 1 changes; this is diagrammatically illustrated by the arrows PF 3, PF4 and PF5. It is the purpose of the regulating arrangement 5 to obtain this variation; the arrangement 5 is controlled by a regulator 37 via the tension roller 4. The operation of the arrangement 5 which drives the take-up 1 must always be adjusted in accordance with the counter force K1 which is exerted upon the tension roller 4 by the workpiece W. The reaction force K2 to the counter force K1 is produced by cylinder and piston units 8 and 9 and is transmitted via the chains 10 and 11 to the mounting arms 6 and 7 on which the tension roller 4 is swingably mounted.

Figure 3:
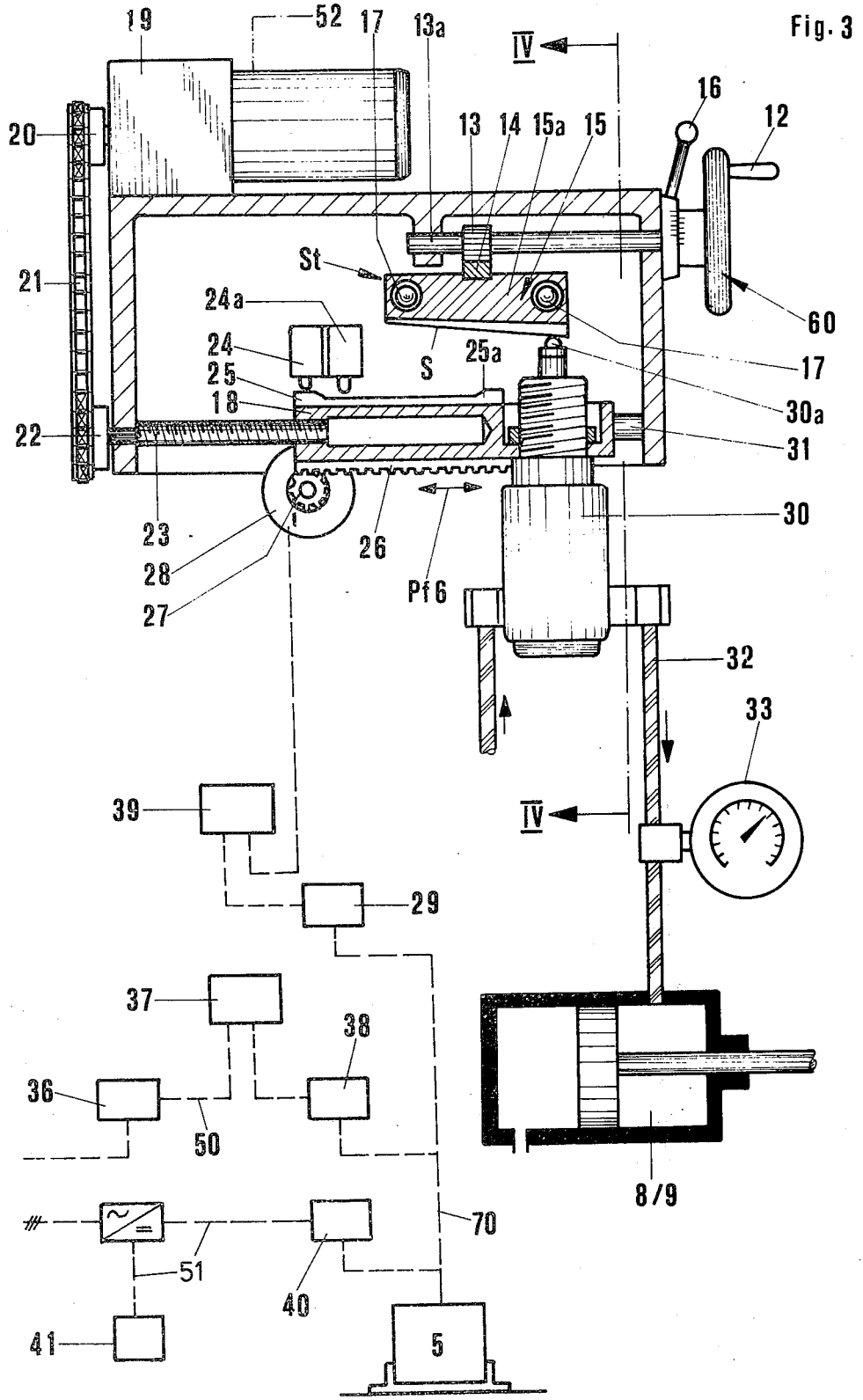
FIG. 3 is a side view illustrating a detail of the apparatus according to the present invention, partly in a section taken on line III—III of FIG. 4.

When the tension roller 4 pivots upwardly or downwardly from its center position, as indicated by the double headed arrow PF1 in FIG. 2, an immediate readjustment of the arrangement will take place. A gear segment 34 transmits the angular deviation in the position of the roller 4 from its central position to a pinion 35 of an associated potentiometer 36. The resistance value of the potentiometer 36 is thus changed with respect to an associated potentiometer 38; this deviation is compensated by the device 37 which applies appropriate impulses to the drive 5. The potentiometer 36, the device 37 and the potentiometer 38 are part of a first regulating circuit and are in electrical connection with one another via the conductor 50 as indicated in FIGS. 1 and 3. A further potentiometer 40 is provided at the drive 5 and is connected via a conductor 51 with an indicator 41 to indicate the respective diameter of the package on the take-up 1, for example on a scale which is subdivided in increments of a millimeter or the like.

A further concept according to the present invention resides in the actual regulating mechanism for the counter force to be produced by the cylinder and piston units 8 and 9, which will be described with particular reference to FIGS. 3 and 4. These Figures illustrate a control slide arrangement which is designated in toto with reference characters ST. A hand wheel 12 is provided with a setting indicator 60 which indicates the respective position of a cam member 15. A handle 16 serves to arrest the hand wheel 12 against undesired or unintentional turning. The cam member 15 includes the block 15*a* which is shown in more detail in FIG. 5 and which is shiftably mounted on two guide rods 17.

Figure 4:
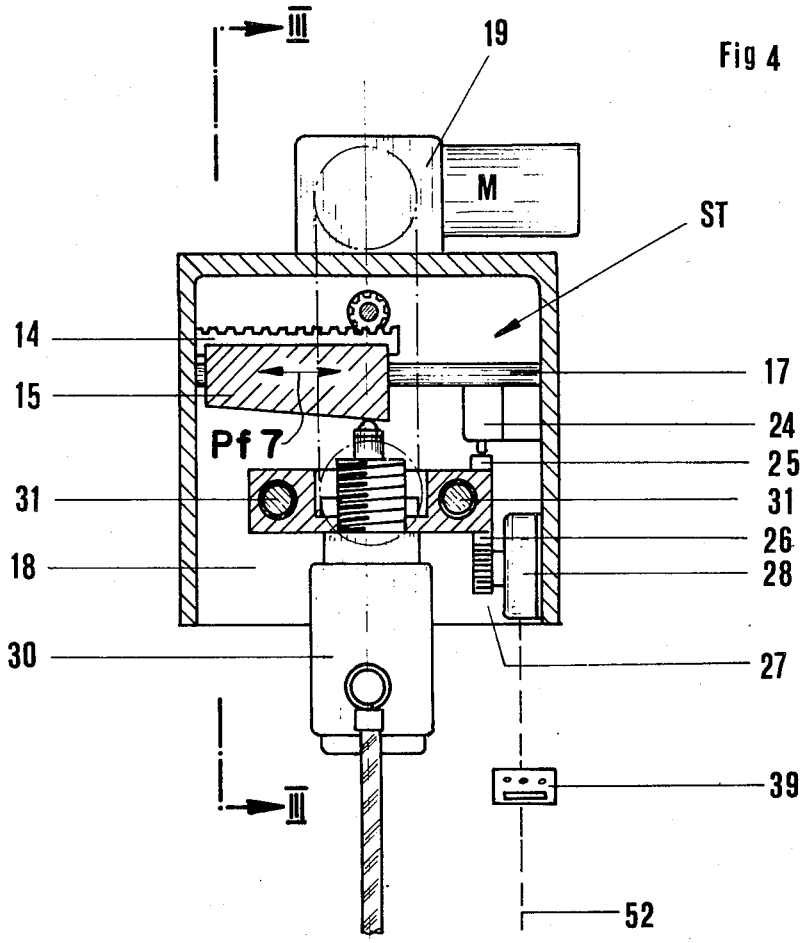
FIG. 4 is a side view partly in section taken on line IV—IV of FIG. 3.

The arrangement of FIGS. 3 and 4 further comprises a follower member 18 which is mounted so that it can be shifted at right angles to the direction of movement of the cam member 15. An electric motor 19 is provided which effects the displacement of the follower member 18 via a sprocket 20, a sprocket chain 21 and a further sprocket chain 22 which drives a threaded spindle 23 to thereby displace the follower member 18 in the direction of the double headed arrow PF6 which is shown in FIG. 3. Two limit switches 24 and 24*a* are provided which are activated when the follower member 18 reaches one or the other of its end positions so that the limit switches 24 or 24*a* are engaged by projections 25 or 25*a*, respectively, of the follower member 18. Each limit switch 24 is also connected with an indicator lamp provided at the control board or console for the machine, so as to energize the respective lamp and indicate that the member 18 has reached one or the other of its end positions. It is also advisable to provide a switch which permits the arrangement in FIGS. 3 and 4 to be switched from manual operation to automatic operation; if the arrangement is set for manual operation it is advantageous that the workpiece tension be maintained constant.

A shaft 13*a* is connected with the hand wheel 12 and carries a pinion 13 which engages in a rack 14 that is mounted on the cam member 15, thereby causing the cam member 15 to be displaced in the direction of the double headed arrow PF7 (FIG. 4), i.e., to be displaced in direction normal to the plane of FIG. 3.

The member 18 is shiftably mounted on the guide members 31 and carries a rack 26 which meshes with a pinion 27 of a potentiometer 28, shown in FIGS. 3 and 4. The potentiometer 28 has a resistance value, or rather a range of resistance values, which corresponds to that of a further potentiometer 29 that is mounted on the drive 5. It is an important aspect of the invention that the potentiometers 38, 29 and 40 which are associated with the drive 5 are mounted on one and the same potentiometer shaft 70, so that they all turn simultaneously and through identical angular distances. The angle of rotation of the potentiometer 29 corresponds to the angular range of the drive 5 and to the range of package diameters of packages to be formed on the take-up 1. Reference numeral 30 identifies a fine-adjusting valve 30 which is mounted on and moves the member 18 and has a contact portion 30*a* which engages the cam surface S of the cam member 15 so that, when the cam member 15 and the member 18 are shifted in the manner already indicated, the contact portion 30*a* will also be displaced, but in vertical direction in FIG. 3, thereby operating the valve 30 and causing a variation in the pressure of the associated secondary fluid line 32. This varied pressure is indicated by the gauge 33 and at the same time causes in the cylinder and piston units 8 and 9 a changed equilibrium condition which is immediately compensated via the drive 5 by the drive for the tension roller 4.

If the tension of the workpiece W increases as the diameter of the package being formed on the take-up 1 increases, the tension roller 4 about which the workpiece W is trained, will be deflected (in downward direction in FIG. 2). The gear segment 34 turns the pinion 35 of the potentiometer 36 and the variation in the resistance of the potentiometer is compared with that of the potentiometer 38 by the regulating device 37. The latter produces a signal which is supplied to the drive 5 and causes the drive to be readjusted until the equilibrium condition is reestablished, that is until the resistance of the potentiometers 36 and 38 is again identical. Since the potentiometer 29 is mounted on the shaft 70, it will also be turned as the potentiometer 36 initiates the adjustment of the drive 5, and the now changed resistance value of the potentiometer 29 influences a further regulating device 39 which adjusts the motor 19 until the two potentiometers 38 and 29 again have identical resistance values. These adjustments are continued during the entire package formation, that is from the very beginning to the very end of the package formation, and take place so frequently that one would be justified in speaking of a continuous regulation of the workpiece tension. The relationship of the adjustment of the workpiece tension with reference to the diameter of the package on the take-up 1 can be selected as desired, by the selection of the cam surface S on the cam member 15. It will be appreciated that the arrangement thus far described assures that the member 18, driven by the motor 19, will be shifted in correspondence with the switching steps which are necessary during the drive of the take-up 1 in order to accommodate the rotational speed of the take-up 1 to the different package diameters. By appropriately configurating the cam member 15, the force which acts at any particular operating time upon the cylinders 8 and 9, can be predetermined. Depending upon the configuration of the cam surface S which is sensed by the contact portion 30a, a desired characteristic for the workpiece tension is obtained throughout the package winding operation. Thus it is possible to select either a workpiece tension which remains constant as the diameter of the package on the take-up 1 increases, or to select a workpiece tension which decreases or increases as the diameter of the package increases.

Figure 5:
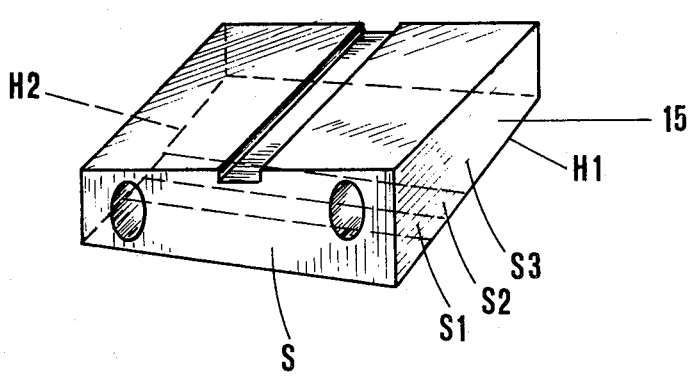
FIG. 5 is a perspective view showing a detail of FIGS. 3 and 4.

FIG. 5 shows the cam member 15*a* in perspective view and reference characters S1, S2 and S3 indicate in very diagrammatic manner individual portions of cam surfaces S which are engaged and sensed by the contact portion 30*a* during a displacement of the member 18. Of course, there could be more than the illustrated three portions S1–S3. The contact surface faces downwardly in FIG. 5 and its contour can be continuous. Depending upon which of the surface portions S1, S2, S3 one selects by shifting the cam member 15 by operation of the hand wheel 12, a corresponding workpiece tension characteristic is selected by reference to the package diameter of the package being formed on the take-up 1; the tension control then takes place automatically. However, by turning the wheel 12 the tension control can also be varied manually by appropriate shifting of the cam member 15 in which case portions of the cam surface S thereof will be engaged and sensed by the contact portion 30*a* in areas extending parallel to the side edges H1, H2 if no automatic tension control is superimposed upon this movement.

The member 15*a* can be readily removed so that it can be replaced with a different one having different contact surface areas S1, S2 and S3. This makes it possible for the workpiece tension intermediate the take-up 1 on the one hand and the arrangement R on the other hand, to vary throughout the formation of a package on the take-up 1 in accordance with a desired characteristic. As mentioned before, the three basic characteristics, namely constant tension, progressive tension or degressive tension, can be selected. In addition, the intensity of the changes in the tension if progressive or depressive tension is selected, can readily be preselected by appropriate use of profiling for the cam surface portions S1, S2 and S3 or others. The apparatus according to the present invention can, of course, not only take up filamentary material, but also tapes or webs, for example textiles, paper or the like, as well as filaments, yarns or the like.

The cam member 15 can be so adjusted by operation of the hand wheel 12 that the member 18 (or rather the contact portion 30*a* of the valve 30 which moves the member 18) senses a cam surface portion S1 which may, for example, have a high initial value and a low terminal value relative to the workpiece tension; in other words, the shape of the cam track surface portion S1 may be such that at the beginning of the winding operation the workpiece tension will be high, and at the end or towards the end of the winding operation, the workpiece tension will be low. The cam member 15 can also be manually moved (by means of the wheel 12) to a different position in which the contact portion 30*a* engages a different cam track surface portion, for example the surface portion S2 (compare FIG. 5). That cam track portion may have a configuration which assures that the initial workpiece tension is different from what was described with reference to the cam track surface portion S1, for example an intermittent tension value may be produced and towards the end of the winding operation a higher or lower workpiece tension may be produced. The cam member 15 can also be manually shifted in direction parallel to its sides H1 or H2.

The manner in which the take-up 1, the rollers 3 and 4, and the cylinder and piston units 8 and 9 are mounted within the machine support 80 is not particularly shown in FIGS. 1 and 2, except in a more or less diagrammatic sense. Measures for so mounting these components are fully conventional and require no detailed explanation. It will be noted that the cylinder and piston units 8 and 9 are turnably mounted on pivots 81.

A perspective view of the machine according to the present invention is also shown in FIG. 13, where the workpiece will be seen to be in form of a whole series of many laterally adjacent filaments, although this is of course shown by way of example only. The machine supports are identified with reference numeral 80, as before, and the arrangement of the rollers 2, 3 and 4 of the take-up 1 and of the cylinder and piston units 8 and 9 is evident. Reference numeral 32 identifies the fluid line.

Figure 7:
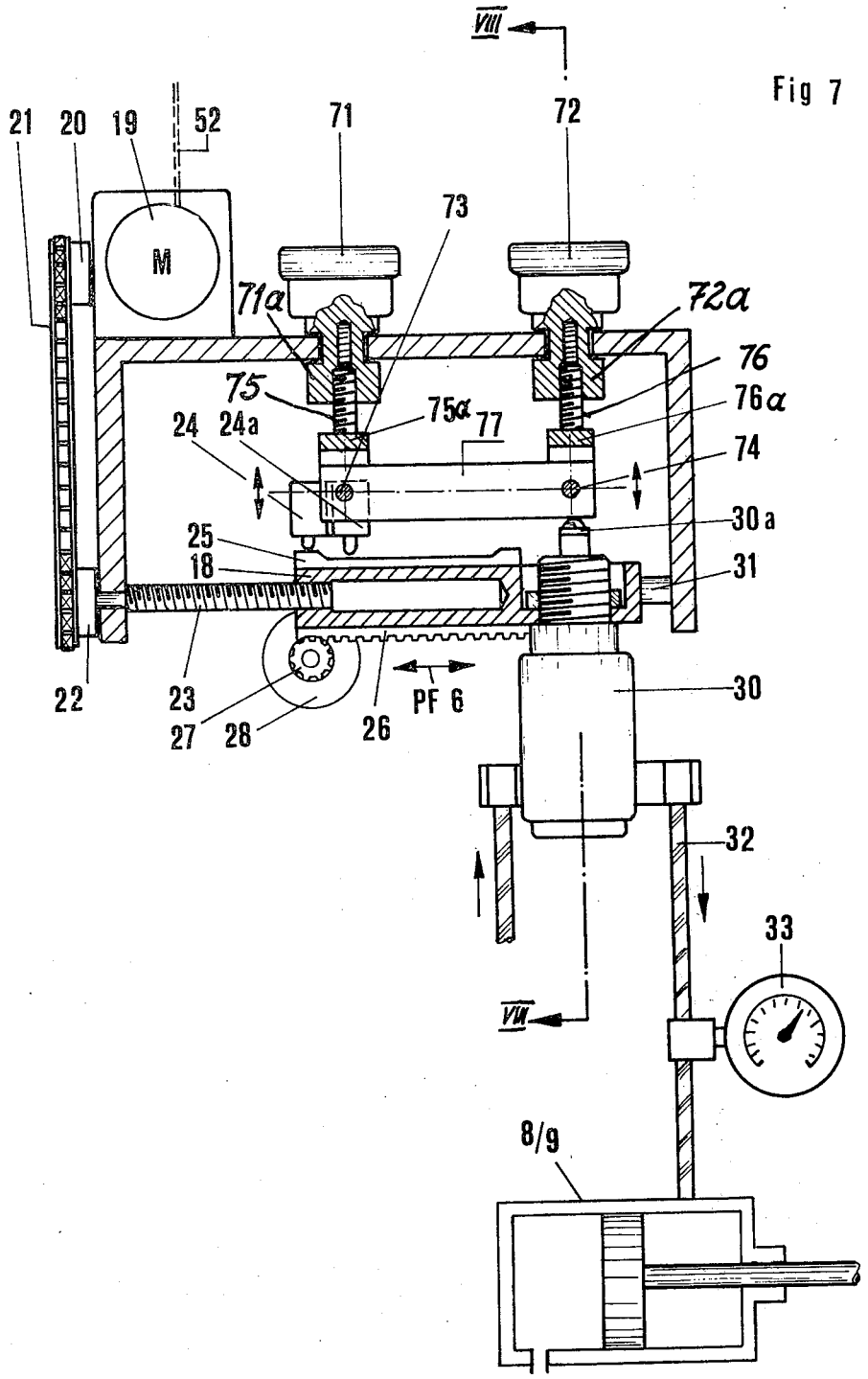
FIG. 7 is a section taken on line VII—VII of FIG. 8.
Figure 8:
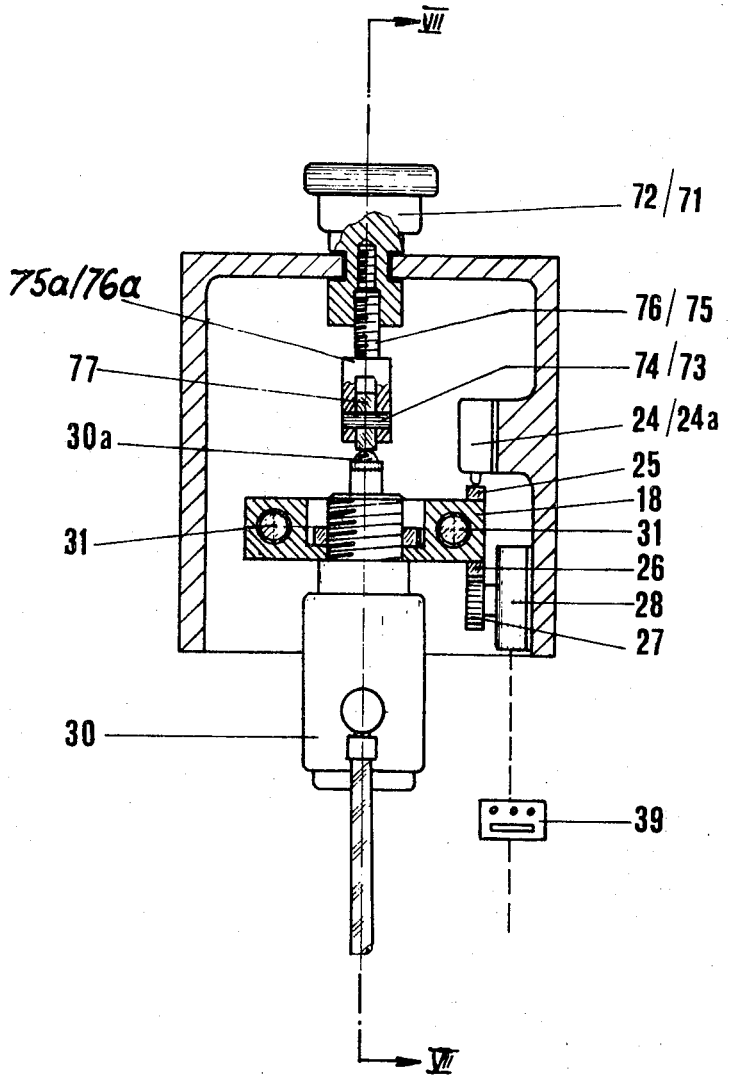
FIG. 8 is a section on line VIII—VIII of FIG. 7.

FIGS. 2, 13, 14 and 15 also indicate how the pressure regulating arrangement of FIGS. 3 and 4 or of FIGS. 7 and 8 can be mounted on the machine. In particular, it is advisable to have the arrangement mounted on a plate 82 of one of the machine supports 80. FIG. 14 shows the arrangement installed in the plate 82, as does FIG. 15. In FIG. 14, a single hand wheel 12 with the associated components 16 and 60 is provided. FIG. 15 shows that in lieu of the arrangement of FIG. 14, it is also possible to use dual hand wheels 71 and 72 each of which is provided with a position indicator 78 and 79, respectively, which are of the same type and have the same purpose as the indicator 60. This arrangement facilitates a preselection of the intended workpiece tension; for example, the operator can preselect a workpiece tension of 300 kg with both hand wheels 71 and 72 and then thereby obtains a corresponding constant workpiece tension throughout the entire winding operation. The arrangement which utilizes two hand wheels as in FIG. 15, will be described with respect to the embodiment of the tension-regulating arrangement in FIGS. 7 and 8.

This arrangement operates analogously to the one described with reference to FIGS. 3 and 4, and analogous elements are identified with like reference numerals. In FIGS. 7 and 8, however, the cam member 15 is replaced with a bar-shaped cam member 77 which can be shifted in direction normal to the movement of the member 18 (and also be moved to an inclined position) by means of two adjusting arrangements; hence the dual hand wheels in FIG. 15.

Figure 9:
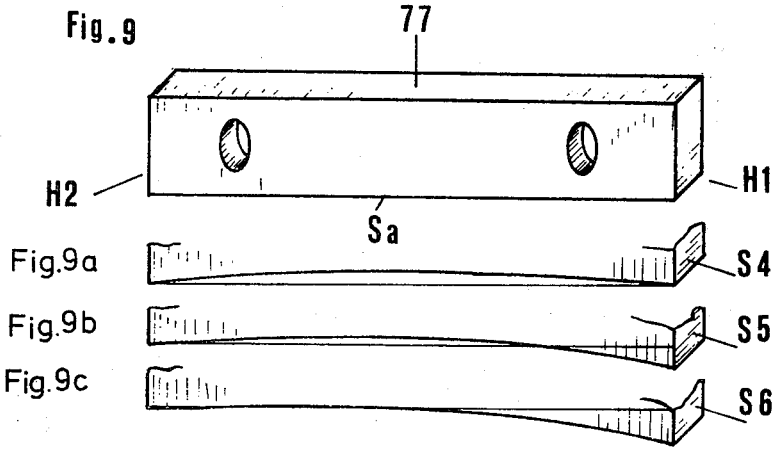
FIG. 9 is a perspective view of an element corresponding to the one shown in FIG. 5, but illustrating a further embodiment of the invention.
Figure 10:
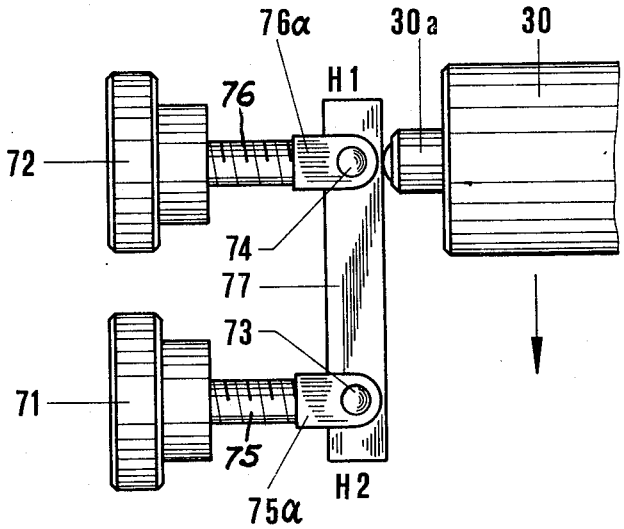
FIG. 10 is a fragmentary detail view showing a control arrangement of the present invention in one operating position in which the workpiece will be subjected to constant tension.
Figure 11:
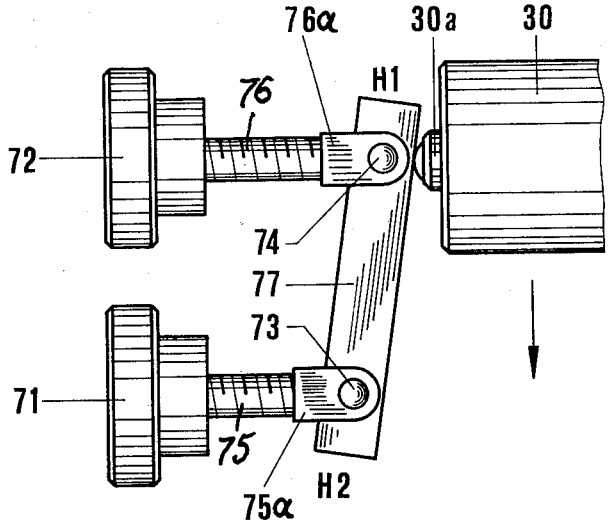
FIG. 11 shows the control arrangement of FIG. 10 in a different operating position in which the workpiece will be subjected to a decreasing tension.
Figure 12:
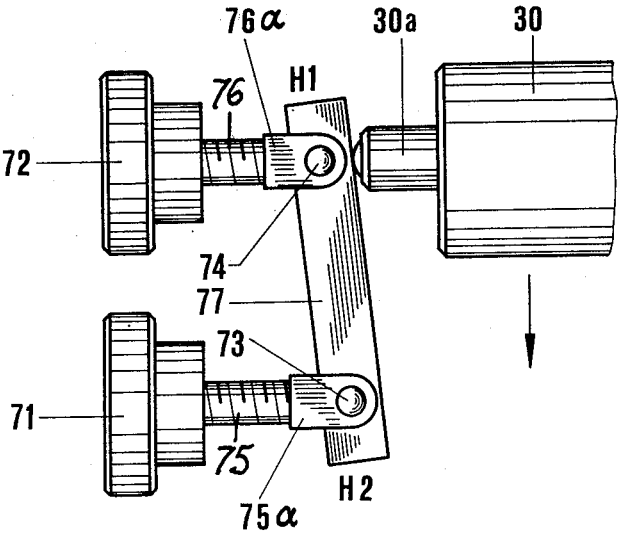
FIG. 12 shows the arrangement of FIG. 10 in a position in which the workpiece will be subjected to an increasing tension.

FIGS. 10–12 illustrate the operation of the adjusting arrangements but firstly the structure will be described in more detail with reference to FIGS. 8 and 9. It will be seen in these Figures that the cam member 77 has opposite end portions each of which is engaged by a threaded spindle 75 and 76 via respective coverings 75*a* and 76*a*. These spindles 75 and 76 can be adjusted in their axial directions by turning of a respective nut 71*a* or 72*a*, which turning is effected by means of the respective hand wheel 71 or 72 (compare FIG. 15). The direction of movement of the spindles 75 and 76 is identified by the double headed arrows shown in FIG. 7. The nuts 71 and 72 are directly connected with the hand wheels 71 and 72, respectively, but this is only for purposes of explanation; they need not be directly connected. The articulated couplings 75*a* and 76*a* engage the cam member 77 via pivots 73 and 74, respectively, (compare FIGS. 7 and 8), and this makes it possible, as shown in FIGS. 10–12, to turn the two hand wheels 71 and 72 through identical angles of displacement, or through different angles of displacement and to thereby preselect the workpiece tension to the desired extent.

FIG. 10 shows the arrangement of FIGS. 7–9 in an adjusted position in which the cam member 77 (which is again engaged by the contact portion 30*a* of the valve 30) has such an orientation that the workpiece will be subjected to constant tension throughout the entire winding operation. If the arrangement is adjusted to the position shown in FIG. 11 (note the inclination of the cam member 77 with reference to the path of movement of the element 18 and the valve 30 as indicated by the arrow) a degressive workpiece tension is obtained, that is the workpiece tension will be high at the beginning of the winding operation and will decrease throughout the winding operation to its end. If the arrangement setting shown in FIG. 12, then the workpiece tension will be progressive, that is it will be lower at the beginning than at the end of the winding operation. The particular mode or characteristic of the workpiece tension is selected by having the cam member 77 assume one of the three basic positions shown in FIGS. 10–12; the magnitude of the tension is selected by shifting the cam member 77 towards or away from the valve 30 (i.e., towards the right or towards the left in FIGS. 10–12). The selected position of the cam member 77 can be fixed by appropriate means so that the member 77 cannot accidentally move out of this position.

The member 77 is advantageously readily exchangable for a different member 77. FIGS. 9 and 9*a*–9*c* show different configurations of the cam track surface on the member 77. FIG. 9 shows the member 77 as used in the illustrated embodiment; the transverse sides of the member are identified by H1 and H2; the cam track surface which is engaged by the contact portion 30*a* is identified with reference character S*a*.

As FIGS. 9*a*, 9*b* and 9*c* show, different members 77 can be installed in place of the member 77 shown in FIG. 9; the cam track surface S*a* of the members 77 in FIGS. 9*a*–9*c* are clearly differently configurated for the surface S*a* of the member 77 shown in FIG. 9. This makes it possible to obtain a particular winding tension characteristic, i.e., a curved contour of the surface S*a* will assure that the workpiece tension varies in a manner analogous to the curvature of the surface SA. Thus, in FIG. 9*a*, for example, the cam track surface S*a* has the configuration S4 where the tension on the workpiece will be high at the beginning of the winding operation, will taper off towards the middle of the winding operation and will increase from the middle towards the end of the winding operation.

Figure 6:
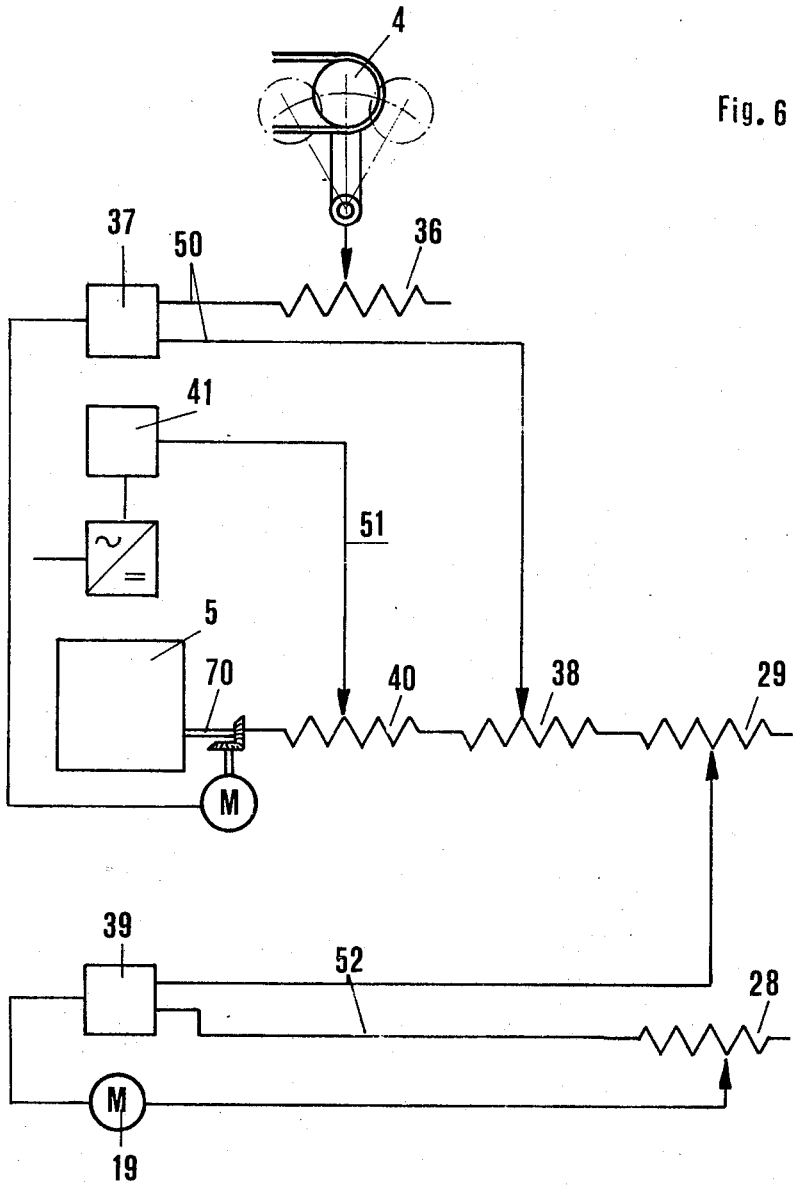
FIG. 6 is a wiring diagram illustrating the electrical control circuit of the apparatus.

FIG. 6 is a circuit diagram showing the cooperation of the various potentiometers and of the drive 5, with respect to the embodiment of FIG. 3. This is believed to be self explanatory and requires no detailed discussion.

It will be understood that each of the elements described above, or two or more together, may also find a useful application in other types of constructions differing from the type described above.

While the invention has been illustrated and described as embodied in an apparatus for forming a package on a rotatable take-up device, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for forming a package on a rotatable take-up comprising a rotatable take-up; first means for feeding an elongated flexible workpiece towards said take-up to be wound onto and form a package on the same, including a swingable tensioning roller adapted to exert tension upon the workpiece; variable second means for rotating said take-up in dependence upon the diameter of the package thereon; fluid-activated third means for said swingable roller to press the same against said workpiece; an electric control circuit for said variable second means, including a first adjustable potentiometer; a tension-control circuit for controlling the tension exerted by said swingable roller, including a second adjustable potentiometer mechanically coupled with said first potentiometer, and a third adjustable potentiometer electrically coupled with said second potentiometer; and fourth means including cam surface means and slidable follower means whose movements are controlled by the adjustments of said third potentiometer, for preselecting the force exerted by said fluid-activated third means upon said swingable roller.

2. An apparatus as defined in claim 1, wherein said fourth means comprises an adjustable cam member having said cam surface means thereon, said follower means being movable relative to said cam member; and wherein said fluid-activated means means comprises a fluid-flow controlling valve connected with said follower means to share the movements thereof and having an activating portion in contact with said cam surface means.

3. An apparatus as defined in claim 2, said fourth means comprising an electric motor, and motion-transmitting means for transmitting motion from said motor to said follower means; and wherein said pressure-control circuit includes an additional potentiometer connected with said motor for controlling the same.

4. An apparatus as defined in claim 3, wherein said motion-transmitting means comprises a threaded spindle which receives motion from said motor and transmits motion to said follower means.

5. An apparatus as defined in claim 3, wherein said cam member is adjustable in direction normal to the path of movement of said follower means.

6. An apparatus as defined in claim 5; further comprising a hand wheel coupled with said cam member for effecting the adjustment thereof.

7. An apparatus as defined in claim 2, wherein said cam surface means comprises a plurality of different cam surface portions which are elongated in the direction of movement of said follower means.

8. An apparatus as defined in claim 7, wherein said cam surface portions are located laterally adjacent one another in direction transverse to the direction of movement of said follower means, adjacent ones of said cam surface portions merging continuously with one another.

9. An apparatus as defined in claim 2, wherein said fourth means comprises mounting means releasably mounting said cam member so as to permit replacement thereof with another cam member having a different cam surface means.

10. An apparatus as defined in claim 2, wherein said cam surface means comprises cam surface portions which are selectively movable into contact with said actuating portion for imparting to said workpiece a tension which is constant, progressive or degressive, at the option of an operator.

11. An apparatus as defined in claim 1, further comprising a workpiece guide roller intermediate said swingable roller and said take-up for guiding the workpiece from said swingable roller towards said take-up in a path in which the workpiece leaves the swingable roller in a direction coincident with a portion of the swing path of said swingable roller.

12. An apparatus as defined in claim 2, wherein said cam member is substantially bar-shaped and said fourth means comprises at least two adjusting devices connected with said cam member for adjusting the same in direction normal to the path of movement of said follower means.

13. An apparatus as defined in claim 12, wherein said adjusting devices comprise adjusting elements for inclining said bar-shaped cam member with reference to said path of movement.

14. An apparatus as defined in claim 13, said bar-shaped cam member having spaced end portions each engaged by one of said adjusting devices; and wherein each of said adjusting devices includes a threaded spindle engaging one of said end portions, and nut means engaging said spindle and operate for shifting the same in axial direction.

15. An apparatus as defined in claim 14, wherein said nut means includes a hand wheel.

16. An apparatus as defined in claim 15, wherein each of said hand wheels includes a dial indicative of the adjustment selected for said bar-shaped cam member.

17. An apparatus as defined in claim 12, wherein said fourth means further comprises mounting means replaceably mounting said bar-shaped cam member so that the latter can be replaced with another cam member having a different cam surface means.

18. An apparatus as defined in claim 17, wherein said cam surface means has a straight contour.

19. An apparatus as defined in claim 17, wherein said cam surface means has a curved contour.

* * * * *